US007320516B2

(12) United States Patent
Kroman et al.

(10) Patent No.: US 7,320,516 B2
(45) Date of Patent: Jan. 22, 2008

(54) APPARATUS, FIXTURE, PACKING, A METHOD FOR MACHINING OF SPECTACLE LENSES

(75) Inventors: Flemming Kroman, Brabrand (DK); Lars Bøjvad Jensen, Højbjerg (DK)

(73) Assignee: Lindberg A/S, Åbyhøj (DK)

( * ) Notice: Subject to any disclaimer, the term of this patent is extended or adjusted under 35 U.S.C. 154(b) by 284 days.

(21) Appl. No.: 10/548,144

(22) PCT Filed: Mar. 5, 2004

(86) PCT No.: PCT/DK2004/000144

§ 371 (c)(1),
(2), (4) Date: Sep. 19, 2005

(87) PCT Pub. No.: WO2004/078392

PCT Pub. Date: Sep. 16, 2004

(65) Prior Publication Data

US 2006/0165499 A1 Jul. 27, 2006

(30) Foreign Application Priority Data

Mar. 7, 2003 (DK) ..... 2003 00354

(51) Int. Cl.
*G02C 13/00* (2006.01)

(52) U.S. Cl. ..... 351/178; 351/110; 408/115 R

(58) Field of Classification Search ..... 351/41, 351/110, 178; 29/26 R; 33/639; 408/1 R, 408/103, 115 R
See application file for complete search history.

(56) References Cited

U.S. PATENT DOCUMENTS 6,170,950 B1 * 1/2001 Yoshida ..... 351/110
6,244,792 B1 * 6/2001 Watanabe ..... 408/1 R
6,378,181 B1 * 4/2002 Cargnel ..... 29/20
6,561,738 B1 * 5/2003 Fujita et al. ..... 408/97

FOREIGN PATENT DOCUMENTS

| | | |
|---|---|---|
| DE | 19733303 | 2/1999 |
| DK | 172260 | 2/1998 |
| EP | 1238731 | 9/2002 |
| GB | 2125450 | 3/1984 |
| GB | 2345871 | 7/2000 |

* cited by examiner

*Primary Examiner*—Huy Mai
(74) *Attorney, Agent, or Firm*—James Creighton Wray; Clifford D. Hyra

(57) ABSTRACT

There is described an apparatus and a fixture used in determining position and for producing assembling holes in a spectacle lens for rimless spectacles. The assembling holes are intended for receiving a U-shaped bracket which is used in fastening bridge and side bar hinge. The apparatus and fixture includes interacting guide pins and guide holes. These guide holes/pins are unambiguously disposed. The guide holes will preferably be placed symmetrically in relation to a hole center line for the lens, when this is placed in the fixation opening of the fixture with the hole center line disposed opposite to markings at the fixation opening. The assembling holes are thus placed symmetrically in relation to the marking. By such a system it is possible to make rimless spectacles that appear very accurate, without special skilled qualifications on the part of the optician to make assembling holes in the lenses.

10 Claims, 12 Drawing Sheets

APPARATUS, FIXTURE, PACKING, A METHOD FOR MACHINING OF SPECTACLE LENSES

This application claims the benefit of Danish Application No. PA 2003 00354 filed Mar. 7, 2003 and PCT/DK2004/000144 filed Mar. 5, 2004, which are hereby incorporated by reference in their entirety.

BACKGROUND OF THE INVENTION

The present invention concerns an apparatus for use in determining the position of and forming of assembling holes in spectacle lenses for rimless spectacles, the assembling holes intended for mounting a bridge and a side bar hinge, and of the type including a holder for the lens and machining means that are movable, preferably in two dimensions, relative to the holder.

The invention furthermore concerns a fixture for spectacle lenses for rimless spectacles and for use in determining the position of and formation of assembling holes in the lens, the assembling holes intended for mounting a bridge and a side bar hinge.

The invention furthermore concerns a packing for use in fixture for spectacle lenses for rimless spectacles and for use in determining position of and formation of assembling holes in the lens, the assembling holes being intended for mounting a bridge and a side bar hinge, the fixture including an opening for fixing the lens at its circumferential edge with the packing disposed between the lens and the fixation opening.

Finally, the invention also concerns a method for fixing spectacle lenses for rimless spectacles by determining position of and formation of assembling holes in the lens, and including:

- fixing the lens in a fixture for correct hole centre line orientation;
- forming the assembling holes;
- mounting a bridge and a side bar hinge in the assembling holes; and
- moving machining means, preferably in two dimensions, relative to the holder.

In the industry of spectacle manufacturing, rimless spectacles have hitherto been problematic for the optician to produce. This is due to that tools and methods up till now put great demands on skill and precision on the part of the optician making assembling holes for mounting bridge and hinge fittings/side bars in the lenses. Among these, a difficulty has particularly appeared at correct positioning of the spectacle lenses in relation to the machining means used for forming the assembling holes. Just a very little turning of axis when positioning a lens in relation to the frame of the machining tool has thus caused a very visible skewness when placing assembling holes and thereby also risk of a distinct skewness in the formed spectacle.

With the known systems, one also desires to use as thin glasses as possible due to weight and appearance of the spectacles. When mounting bridge and hinges occurs in such lenses, the thinner the lenses the greater demands are put on precision.

Furthermore, from the user there are demands to placing the assembling holes/slits as close to the edge of the lens as possible with regard to the general appearance and so that fastening members become less visible in the field of vision. This is particularly the case when the models are relatively small.

Usually, when making lenses it is important to be able to place the spectacle lenses with optical centre correctly in relation to the user. Correct positioning is particularly important on small models where progressive lenses are used. In such lenses, a slight displacement and very small axis deflections of 2-3° may produce big sight problems for the user. By known embodiments, assembling holes in the shape of slits or round holes positioning systems are placed by manual marking of the lens. In some cases, this also occurs under use of simple drill jigs or measuring jigs with basis in manual markings on the lens. This puts great demands on skilled measurement, where the precision depends on the care and the ability residing with the individual optician.

When the optician grinds a lens, there will be tolerances on the so-called box dimensions. Box dimensions are the rectangle where the circumference of the lens can be ground in. A datum line will appear at the same time as the centre line of the height of the box dimension.

The optician will typically measure the width in the box. With the tolerances existing for machines used for grinding today, there is risk of tolerance deviation on the height/width of the box dimension. Therefore, there will be a risk of variations in the box dimensions of the lens. This often entails that the optician grinds lenses with undersize, meaning in turn that the lens becomes too small in relation to a template. When the optician is subsequently to place assembling holes in the lens, this occurs by pressing the lens against a sidewall where the hole is to be made. However, this gives rise to uncertainty at the formation of the assembling holes.

SUMMARY OF THE INVENTION

It is the purpose of the invention to relieve the drawbacks hitherto associated with positioning of and formation of assembling holes in lenses and to provide a system and a method whereby rimless spectacle lenses can be produced very accurately without special, skilled qualifications on the part of the optician.

According to the present invention, this is achieved with an apparatus of the kind mentioned in the introduction, which is peculiar in that the holder includes a fixture having an opening for fixing the lens at its circumferential rim and which has at least two first guide means that interact with two corresponding second guide means on the apparatus frame, and which are disposed unambiguously, preferably symmetrically, in relation to a hole centre line for the lens when the latter is placed in the fixation opening.

According to the invention, the fixture forming part of the system will be peculiar in that it includes an opening for fixing the lens at its circumferential edge and at least two first guide means that are arranged for interaction with two corresponding second guide means on a frame in an apparatus in which the fixture will be placed, and which is placed unambiguously, preferably symmetrically, in relation to a hole centre line for the lens when the latter is placed in the fixation opening.

The method indicated according to the present invention is peculiar in that the lens is fixed in a fixture having an opening for fixing the lens at its circumferential edge, that the fixture is fixed in an apparatus via at least two first guide means that are brought to interact with two corresponding second guide means on the apparatus frame, the first guide means being disposed unambiguously, preferably symmetrically, in relation to a hole centre line for the lens, when the latter is placed in the fixation opening.

The packing indicated according to the present invention is peculiar in that the packing is largely rectangular with cut off corners, preferably for forming a largely cross-shaped packing, and that the packing is formed by a resilient material.

In the present invention, by hole centre line is meant a line passing through a centre point for assembling holes or assembling slits and which is parallel with the datum line of the lens. If the assembling holes are disposed at the centre of a lens, the hole centre line and the datum line will coincide.

As the fixture has an opening fixing the lens at its circumferential edge, the risk of axis turning is avoided. The fixing opening will have a position and place in the fixture which is well-defined in relation to the placing of the first guiding means in the fixture. Hereby it becomes possible to perform a precise disposition of the hole centre line of the lens when it is placed in the fixation opening. This is substantially difficult from the prior art where the optician was to fasten the lens according to a visual assessment, with a hole centre line oriented from lines located on a table or a base.

As the fixture has at least two first guide means, two fixation points are achieved which unambiguously can define the position of the hole centre line. Preferably, the two first guide means will be placed as openings or pins which are disposed symmetrically at each their side of the hole centre line. These guide means can interact with corresponding guide means on the apparatus frame. Hereby, the position of the lens will be well defined in relation to the apparatus and thereby also to the machining means of the apparatus. Thus it is possible to perform a very precise positioning and formation of the assembling holes.

The fixture may be used as a negative lens jig so that the optician can ensure that the lens is ground with correct size and shape. Furthermore, marking of the hole centre line in the lens can be aligned with a corresponding marking of the hole centre line in or at the fixation opening in the lens jig, sot that the optician may also ascertain that the lens not only has the correct shape but that the hole centre line of the lens is also oriented entirely correct in relation to the marking placed in immediate vicinity of the fixation opening of the fixture. The control means will thus be disposed symmetrically in relation to the markings of the fixture for the hole centre line as well as the marking of the lens of the hole centre line.

It is preferred that the control means are disposed symmetrically in relation to the hole centre line, but it is possible to place them at other unambiguous positions in relation to the hole centre line.

The packing according to the invention enables placing the lens in the fixation opening. The packing will be squeezed by the lens which is then fixed correctly in the opening with guidance vertically as well as laterally. As the packing is made without corners, either by cutting off corners or by making with cross-shape, problems with folding in corners are avoided, though sufficient guiding of the lens is achieved, as the longitudinal and side faces on the lens are in contact with the packing. It is preferred that with the packing about 80% of the circumference of the lens is covered, however, yet it is possible to have as narrow an extension of the packing material between the cut off corners so that a covering as low as about 60% of the circumference of the lens is attained.

The rubber-elastic material is preferred to have a Shore between 40 and 60. The packing material may be produced of an elastomer, of silicone, a rubber material or other resilient material.

For most practical purposes, the packing will have a thickness in the magnitude of about 1 mm for use in a fixture made with a dimension which is nominally about 9/10 mm over the nominal dimension of the lens. By using such a combination it is possible to compensate for lenses irrespectively whether they are made undersize or slightly oversize relative to the exact dimension of the lens.

As an alternative to making a separate packing for laying in the fixture, it will also be possible to make a fixture having an elastic, flexible edge list in the fixation opening. Such an elastic fixation list in the fixation opening may e.g. be formed of an elastic O-ring which is held in a fixation groove inside the circumference edge of the fixation opening. Such a packing may be used for engaging the circumferential edge of the lens.

According to a further embodiment, the apparatus and the fixture are peculiar in further including an elastic ring for placing in a fixation opening at a position between the lens and the apparatus frame for fixing the position of the lens in direction perpendicularly to the plane of the fixation opening, as the lens is pressed down against the ring which thereby is brought into contact against the frame on which the fixture is placed. Hereby is achieved a possibility for correct positioning of the lens relative to the frame and thereby also relative to a plane perpendicular to the fixation opening. Thus it is possible to fix the lens spatially during machining, which thereby can be performed very accurately, not only in the plane of the lens but also in directions perpendicularly thereto, ensuring that inclining assembling holes for the bridge and side bar hinges are not formed.

According to a further embodiment, the apparatus and fixture are peculiar in that arms projecting from the ring are provided, and that the fixture includes cutouts for accommodating the arms in a fixed engagement. In a simple way is hereby achieved a correct positioning of the ring in the fixation opening, and the optician's work is facilitated by the ring being secured in relation to the fixture.

According to a further embodiment, the apparatus is peculiar in that a pressure pad is supported on the frame and arranged displaceable in a plane largely in parallel with the fixture so that it can be disposed opposite to the lens in the fixation opening and displaceable in direction perpendicularly thereto for pressing and fixing the lens in a contact position in the fixation opening. The bearing of the pressure pad against the lens will occur in the so-called box centre.

According to a further embodiment, the apparatus and fixture are peculiar in that first and second guide means are guide pins and guide holes, respectively. Hereby is achieved technically simple means for positioning the fixture. The fixture will be held in place by the force of gravity when the guide pins are placed in the guide holes. The guide holes will preferably be placed in the fixture.

If the fixture is a moulded plastic article, the guide holes and the fixation opening may be formed at the moulding, so that the fixture can be moulded in large series with exact shape which the optician can use without any need for machining or adaptation.

Alternatively, the guide holes and fixation opening can be formed by machining a pre-form or blank.

According to a further embodiment, the apparatus and fixture are peculiar in that the fixture has opposing side faces, and that the fixation opening is a through-going opening between these side faces, and that there is provided first control means on both side faces. Hereby, there will only be need for one fixture for a right and a left spectacle lens, irrespectively if the two spectacle lenses are identical or not.

According to a further embodiment, the fixture is peculiar in that it includes a packing for disposition between the lens circumferential edge and the fixation opening which is oversized in relation to the lens. Hereby, the need for tolerances in the lens box dimensions and risk of imprecise positioning of the assembling holes is reduced. The dimensions for the fixation opening may nominally be greater than the lens dimension, e.g. with 9/10 mm over the lens dimension. It may be said that the packing acts as compensating means for the oversize of the fixation opening.

The optician turns the fixture with one side facing the apparatus frame when machining one lens and with the other side face facing the frame when machining the other lens. This is possible as spectacle lenses will normally always be symmetrical, irrespectively whether they are identical or not. By using one fixture for both lenses, it is particularly ensured that the formed, rimless spectacle will be symmetrical, without demanding special skilled abilities on the part of the optician.

With the method according to the invention, there will always be a secure positioning of the lens so that the hole centre line is placed correctly when the lens is placed in the fixation opening. The guide means of the apparatus interacting with the guide means on the fixture will ensure the correct position for the subsequent formation of the assembling holes.

If by the method a separate packing is used, this will be disposed over the fixation opening before the lens is pressed in. Hereby, the lens is pressed into the fixation opening simultaneously with the packing being clamped between the circumferential edge of the lens and the inner side of the fixation opening of the fixture. The fixture is then placed in the apparatus, and assembling holes are formed in the way which is analogous to the way by which the assembling holes are formed in a lens mounted in the fixture without using the packing.

DESCRIPTION OF THE DRAWINGS

The invention will now be explained more closely with reference to the accompanying drawing, where:

BRIEF DESCRIPTION OF THE DRAWINGS

Figure 2:
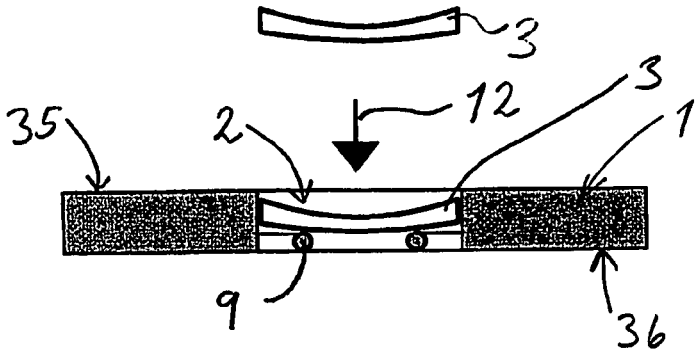
Figure 1:
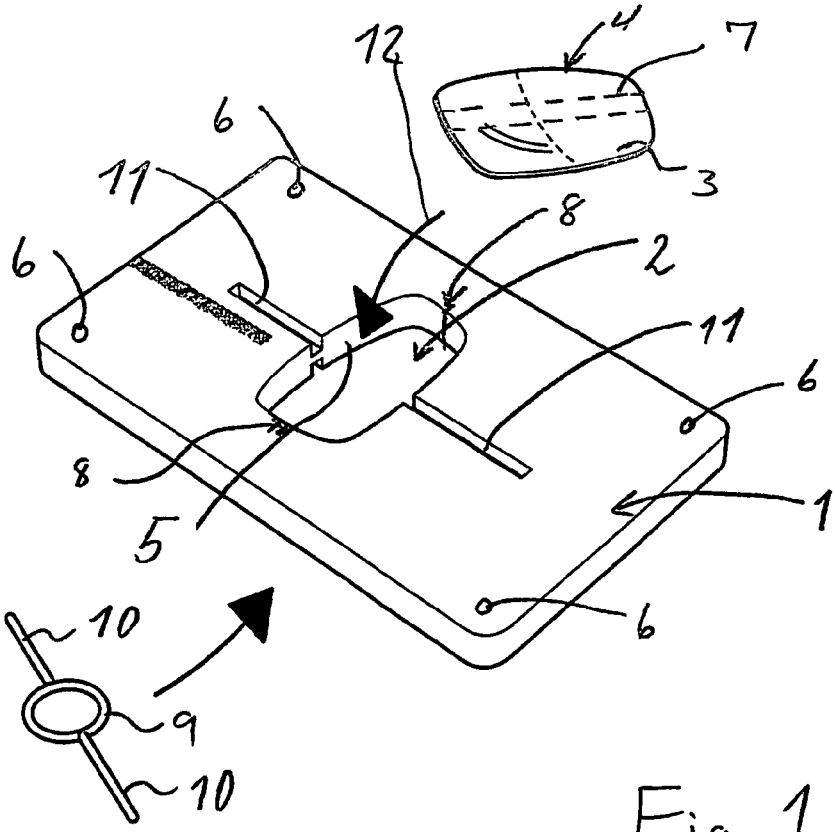
Figure 3:
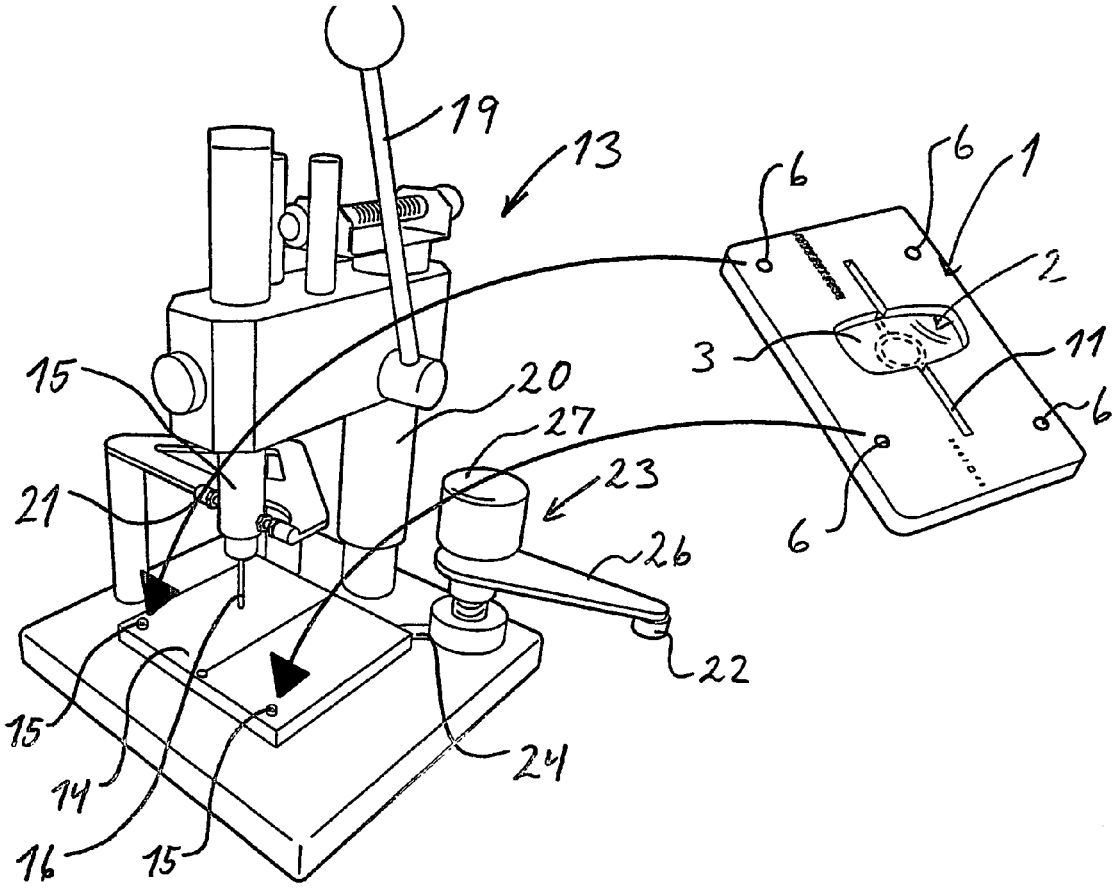
Figure 4:
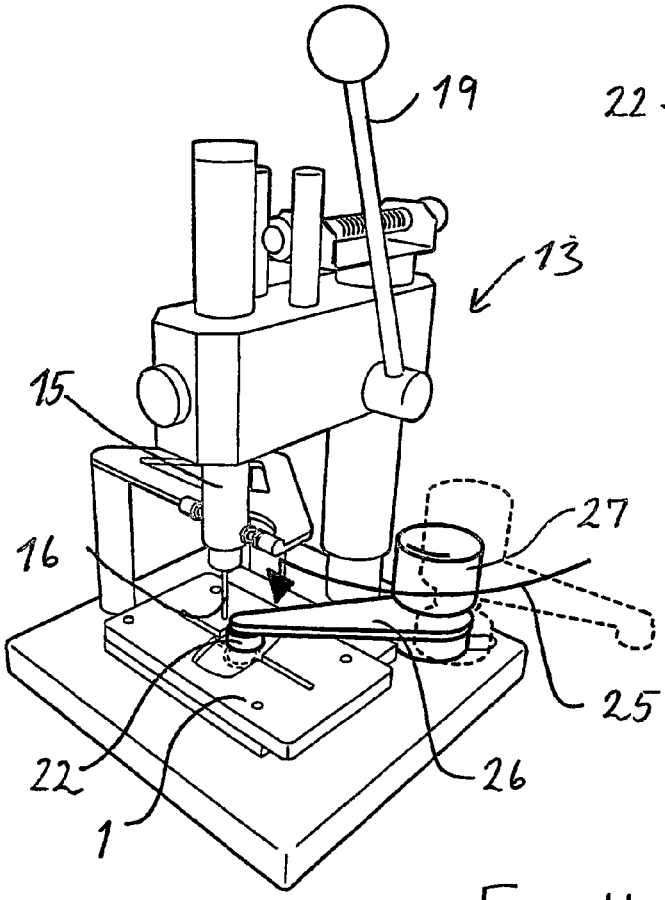
Figure 5:
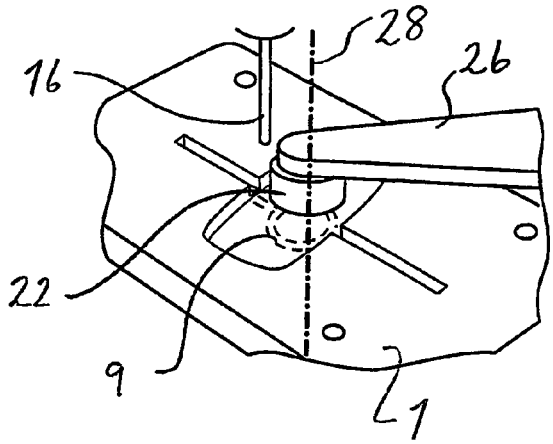
Figure 6:
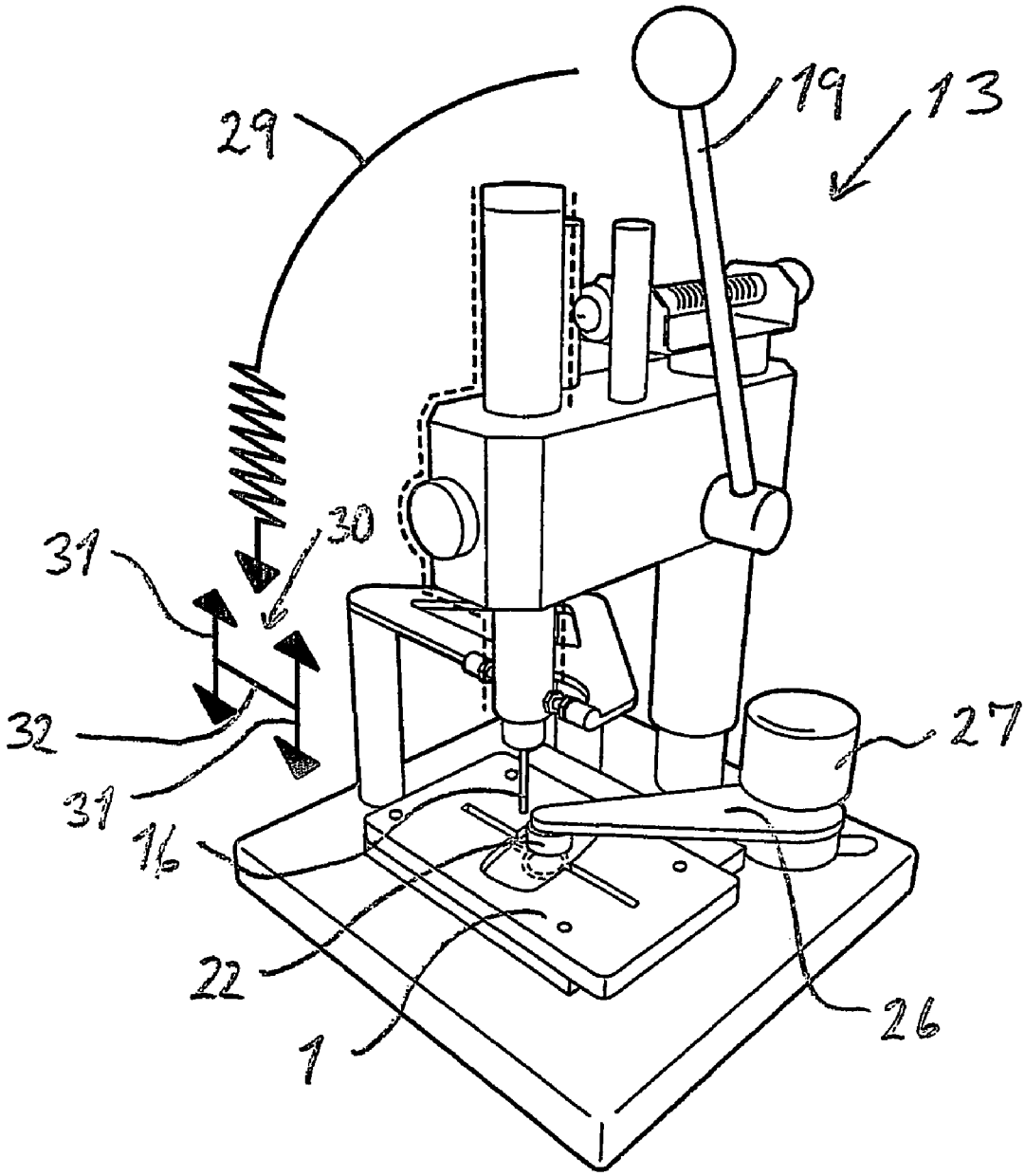
Figure 7:
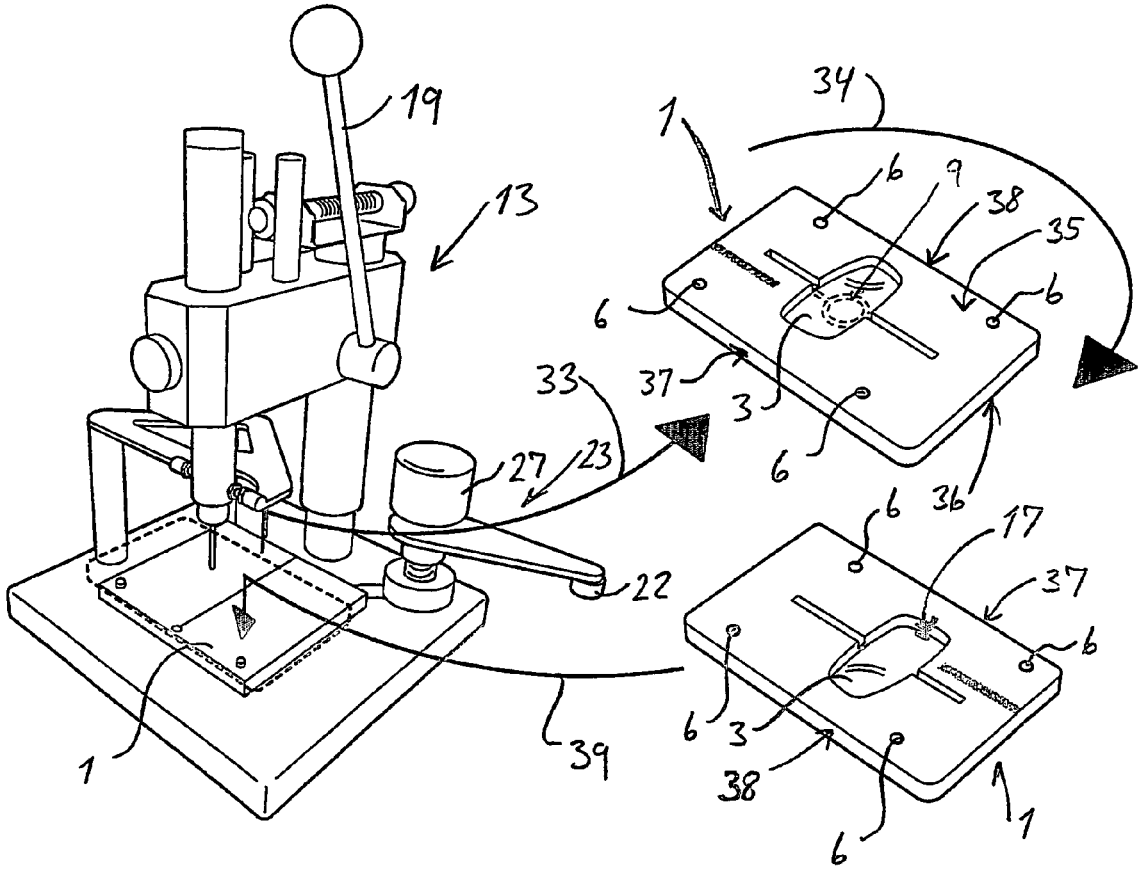
Figure 8:
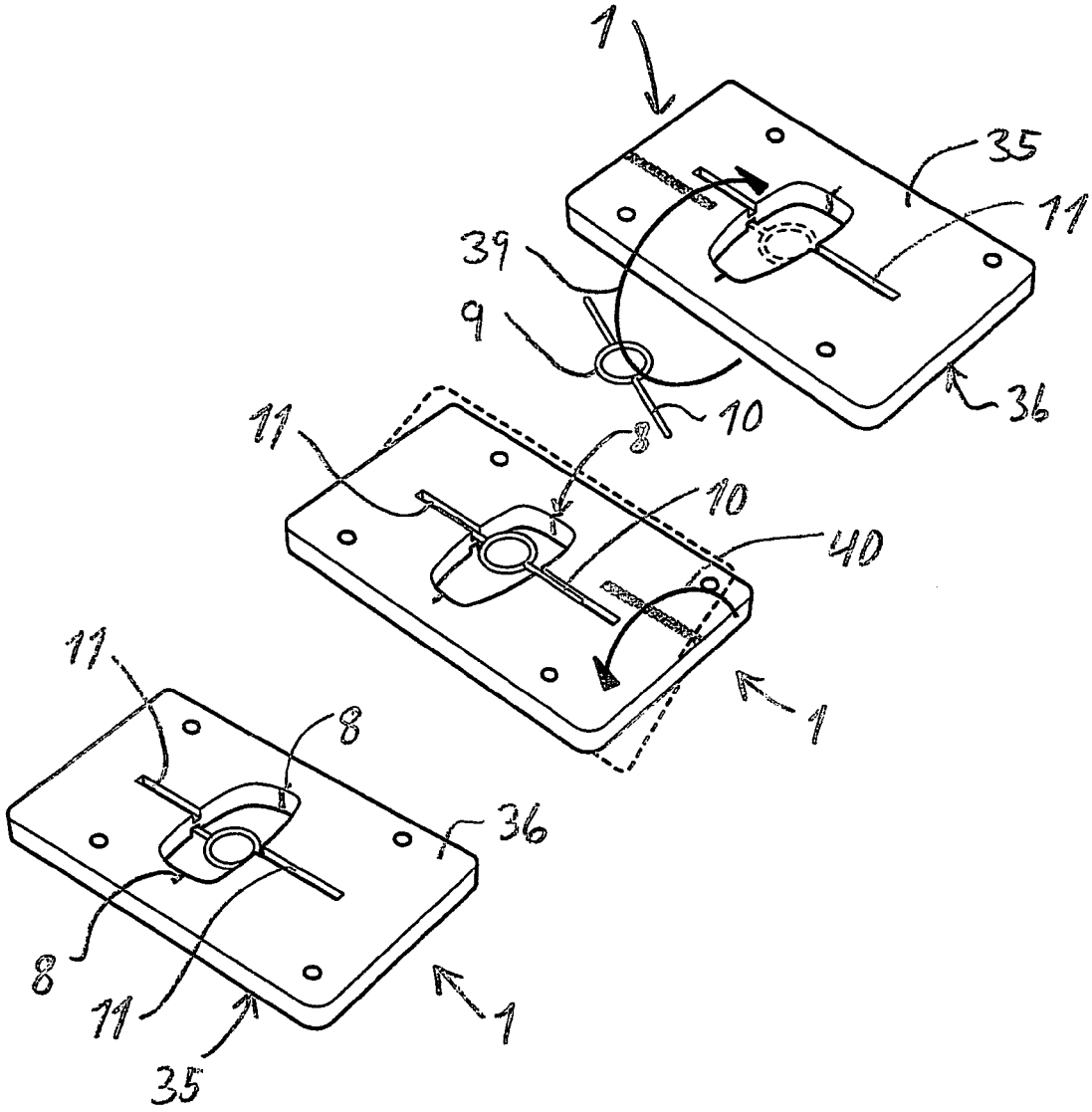
Figure 9:
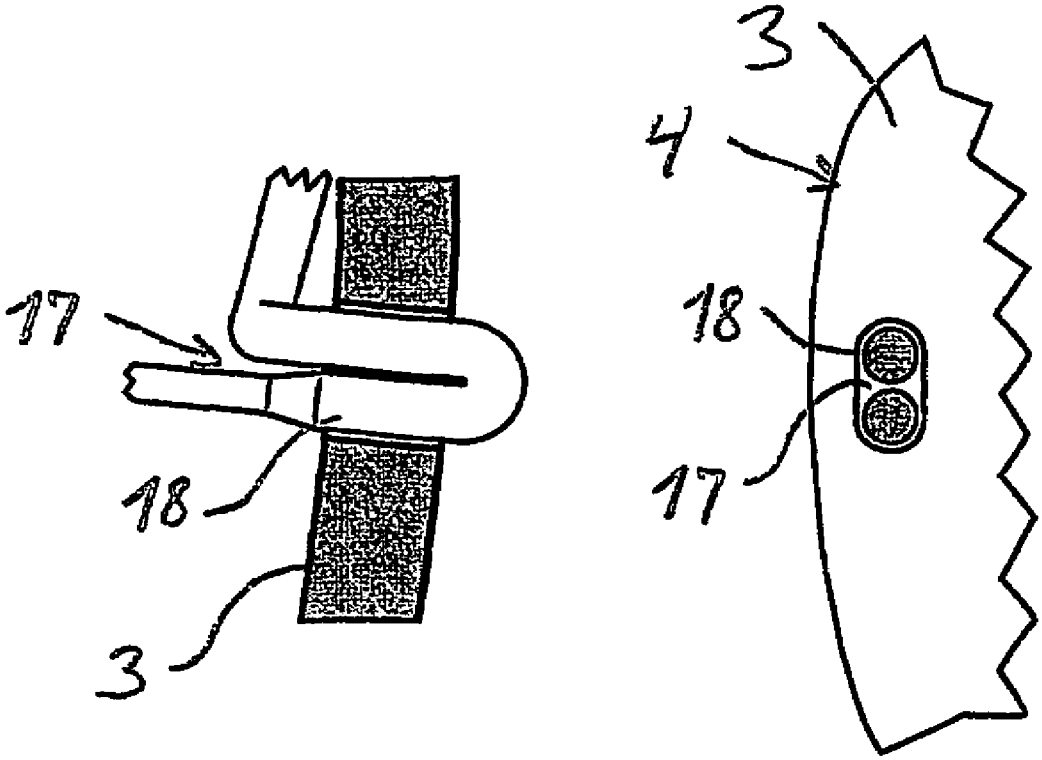

FIG. 1 shows a perspective view of a fixture according to the invention;

FIG. 2 shows a cross-section through the fixture shown in FIG. 1,

FIG. 3 shows a perspective view of an apparatus according to the invention for use together with the fixture shown FIGS. 1 and 2;

FIG. 4 shows a perspective view corresponding to FIG. 3 but with the fixture placed on the frame of the apparatus;

FIG. 5 shows a schematic, partial view of a detail in the apparatus shown in FIG. 4 for illustrating securing of a lens in the fixture;

FIG. 6 shows a perspective view corresponding to FIG. 4 for illustrating the apparatus under formation of assembling holes in the lens;

FIG. 7 shows a perspective view of the apparatus during turning the fixture for forming additional assembling holes in the lens;

FIG. 8 shows perspective views for illustrating turning the fixture in order to fix another symmetric spectacle lens in which assembling holes are to be formed subsequently;

FIG. 9 shows a perspective view through an assembling hole in a lens and a plan view of the assembling hole with a U-shaped bracket placed therein; and FIGS. 10-16 show views corresponding to FIGS. 1-7 for illustrating the method for forming assembling holes during use of a packing in the fixture.

DETAILED DESCRIPTION OF THE PREFERRED EMBODIMENTS

In the following, identical or corresponding elements in different FIGS. will be provided the same designations, and therefore no explicit explanation to all elements in each FIG. will be given. Also, there will not be given any specific explanation to the parallel elements in FIGS. 10-16. Also here will be given an explanation to the difference occurring by using a packing together with the fixture in contrast to using a fixture without a packing, as illustrated in FIGS. 1-7.

In FIG. 1 is seen a fixture 1 with a fixation opening 2 for fixing a spectacle lens 3 by bringing the circumferential edge 4 of the lens in contact with the inner circumferential edge 5 of the fixation opening 2. The fixture is provided with guide means in the form of guide holes 6. The guide holes 6 are provided in pairs symmetrically about a hole centre line 7 for the lens when the latter is placed in the fixation opening 2. By being placed in the fixation opening 2, the hole centre line 7 will be located opposite to a marking 8 that indicates where the hole centre line is to be when the lens is placed in the fixture.

An elastic ring 9 is provided with two projecting arms 10. The fixture 1 is provided with cutouts 11 for accommodating the arms 10 so that the elastic ring is located in the fixation opening.

By placing the ring 9 in the fixation opening, the lens 3 can be disposed correctly as illustrated in the cross-section shown in FIG. 2. The arrow 12 illustrates how the lens 3 is displaced into the fixation opening 2 until it is bearing against the ring 9. The ring 9 will be secured in relation to the fixture, as the arms 10 will be of an elastic material and have a size which is slightly greater than the cutouts 11 so that they are elastically secured in relation to the fixture.

FIG. 3 shows how the fixture 1 with the lens located therein is placed in an apparatus which is generally designated 13 and which includes a frame 14 on which the fixture 1 is placed. The frame 14 is provided with guide pins 15 that interact with the guide holes 6 in the fixture 1. The fixture and thereby also the lens are hereby disposed correctly in relation to machining means in the shape of a drilling machine 15 which is provided with a drill 16 used for forming assembling holes 17 (see FIG. 9) in the lens. The assembling holes 17 are, as it appears from FIG. 9, intended for receiving a U-shaped bracket 18 which in a known way is fastened in the assembling hole 17 due to the elastic force in the bracket that is used for mounting of use and side bar hinges. Thus assembling holes are 17 are provided at each side of a lens.

The machining apparatus shown in FIG. 3 includes an operating handle 19 which is used for moving the drill 16 up and down. Furthermore, the drill is suspended in a pivotable column 20. The pivotability for the drill 16 is limited as the drilling machine only can be displaced between two adjustable stops 21 (only one is visible in FIG. 3). By forming an assembling hole, the drill diameter determines the width of an assembling hole 17, and the setting of the stops 21 defines the length of the assembling hole. When the fixture 1 is placed on the apparatus frame 14, the elastic ring 9 will bear against the frame 14. In order to secure the lens 3 in correct position in the fixation opening 2, the apparatus is provided with a pressure pad 22. This is supported in a support holder 23 mounted displacing in a groove 24 in the apparatus 13.

As indicated by an arrow 25 in FIG. 4, the pressure support holder 3 is arranged on a pivoting pressure pad, from a neutral position where the fixture is readily placed on the frame 14, to a position where the pressure pad 22 is situated opposite to the ring 9. By pivoting the support holder 23 the arm 26 is thus brought from a position where the arm 14 is free, to a position in over the fixture when the latter is placed on the frame, as shown in FIG. 4. Then an axial displacement of the pressure pad 22 is performed down against the lens 2 by turning a screw-threaded head 27 in the support holder 23. Hereby, the pressure pad 22 is pressed down against the lens 3 so that it is secured between the pressure pad 22 and the ring 9 in a correct position. The correct position for the pressure pad 22 will be a bearing against the lens in the box centre.

As it appears from FIG. 5, the pressure pad 22 and the ring 9 will be placed around a common axis 28 so that a skew pressure on the lens 3 will not occur. In this position, the table 16 will be positioned opposite to the intended position for an assembling hole.

FIG. 6 illustrates formation of an assembling hole 17 in the lens 2. An arrow 29 indicates that the user presses the handle forward whereby the drill 16 is displaced downwards and drills a hole in the lens 2. Since the drilling machine 15 can be swung between two extreme positions defined by the stops 21, the side of the drill 16 will cut an oblong slit in the lens when the user pivots the drilling machine 15 from side to side. This operation is indicated by the arrows 30 where it appears that up- and downward motions 31 are performed with the drill and a lateral movement 32 in relation thereto.

As alternative to a slit-shaped assembling hole 17, it is possible to form two juxtaposed, round assembling holes (not shown). Fastening bridge and hinges may hereby be effected with two holes or one hole and a groove in the circumferential edge of the lens. It is necessary to have two holes at each fastening element for the sake of absorbing moment. The formation of a slit is thus just a possible design of the assembling hole 17 for interacting with the above mentioned U-shaped bracket 18.

FIG. 7 illustrates that the pressure pad 22 is released and that the support holder 23 is pivoted to its position outside the frame 14. The fixture 1 may hereby be lifted free of the frame 14 as indicated by the arrow 33. Then the fixture is turned as indicated by the arrow 34. In this way, a side face 35 of the fixture will still face up against the tool, whereas a side face 36 will be placed against the frame 14.

It is here remarked that the fixture advantageously is formed with four guide holes 6 for interaction with the guide pins 15. By forming the first assembling hole 17 in the lens, the guide holes 6 disposed at a first longitudinal edge 37 will engage the guide pins 15. After the turning according to the arrow 34, the guide holes 6 at an opposite longitudinal edge 38 will be brought into engagement with the guide pins 15. In this position, the lens 2 will be placed correctly for forming the second assembling hole in the lens when the fixture, as indicated by the arrow 39, is placed on the arm 14.

It is noted that in the above explanation, reference is made to guide holes 6, and that in the shown illustration these are placed at the side face 35 of the fixture. In reality, it will be guide pins 6 which are placed at the side face 36 of the fixture which is brought into engagement with the guide pins. However, the guide pins 6 will be provided as through-going holes, but may alternatively be provided as various bottom holes at the side faces 35, 36 of the fixture 2.

After the above mentioned turning of the fixture, the above described operations with the intention of clamping the lens and forming the assembling hole are repeated. Then the lens is released again, and the fixture 1 is lifted off the frame. The lens will now be provided with the two assembling holes for mounting bridge and side bar hinge.

The fixture is formed with a through-going fixation opening 2. This means that a symmetrical spectacle lens together with the first mentioned lens are to be used for making a spectacle also can be provided with assembling holes by using the same fixture. It is only necessary to remove the ring 9 from the cutout 11 at the side face 36 and as indicated by the 39 in FIG. 8 move the ring 9 to the opposing side face 35 and place the arms 10 in the cutouts 11 at the side faces 35. Then the lens is turned 180° as indicated by the arrow 40. Then the side face 36 will face upwards against the machining tool, and a lens, which is symmetrical relative to the first lens, can now be placed in the fixation opening 2 by a method as described above. Then assembling holes can be formed in a way corresponding to that described above.

By correct positioning of the spectacles, not only a situation without risk of turning the axis can be achieved. Furthermore, a very certain position of the assembling holes is achieved. Hereby, it becomes possible to make the assembling holes 17 and place them very close to the circumferential edge 4 of a spectacle lens, in the way appearing from FIG. 9. Thus there will be no risk of the assembling hole 17 being placed inadvertently close to the circumferential edge 5 so that there is risk that the lens 3 does not have the required strength properties at the subsequent mounting of the U-shaped bracket 18.

Figure 11:
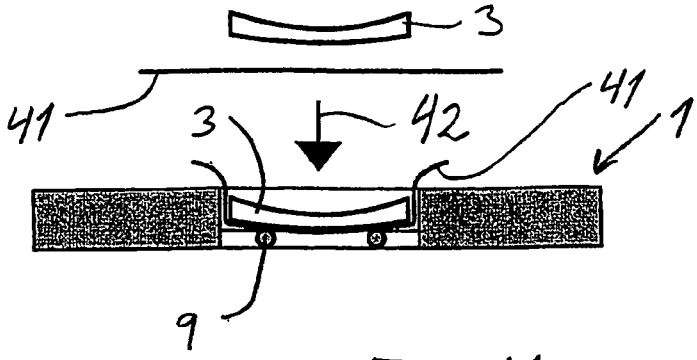
Figure 10:
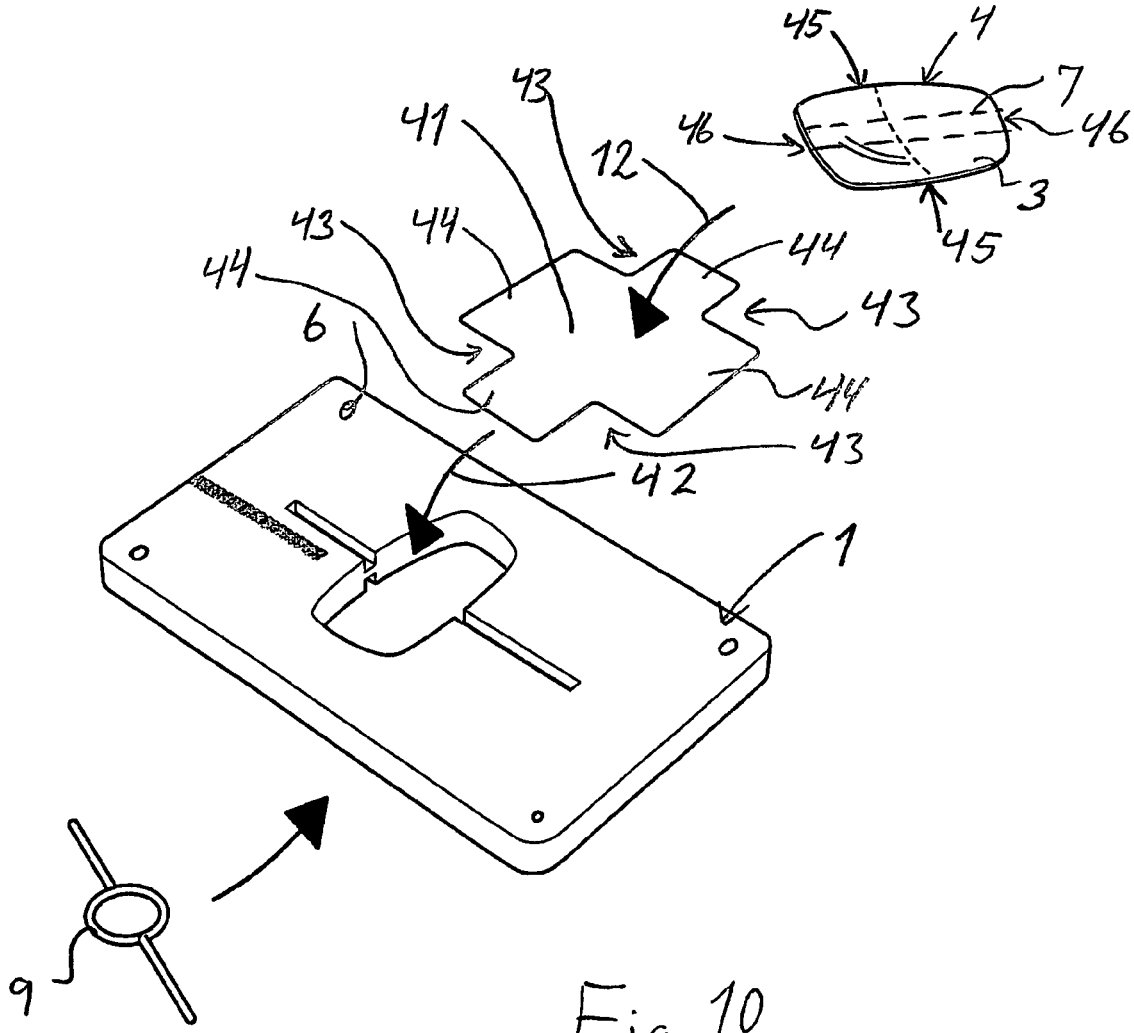

FIG. 10 corresponds to FIG. 1, but it is shown here how a packing 41 is placed between the lens 3 and the fixture 1. In FIG. 11 is illustrated how the packing 41 is displaced according to the arrow 42 into the fixation opening 2 when the lens 3 according to the arrow 12 is placed against the top side of the packing 41 and pressed into the fixation opening 2.

The packing 41 is cut off at the corners 43 so that cross-shaped arms 44 are formed. The cruciform arms will cover about 80% of the circumferential edge 4 of the lens. The cruciform arms 44 will bear on the longitudinal edges 45 of the lens and the side edges 46 of the lens, respectively.

Figure 12:
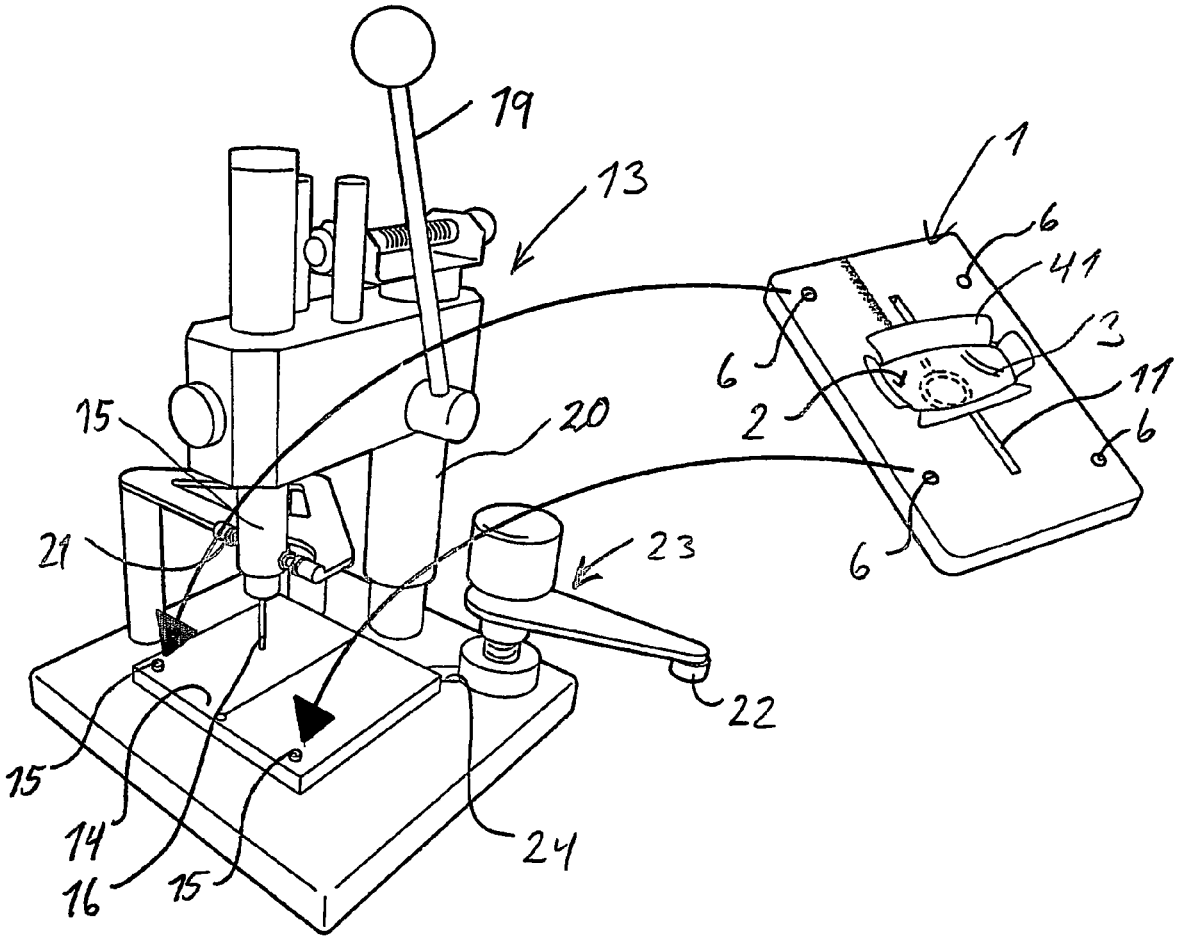
Figure 13:
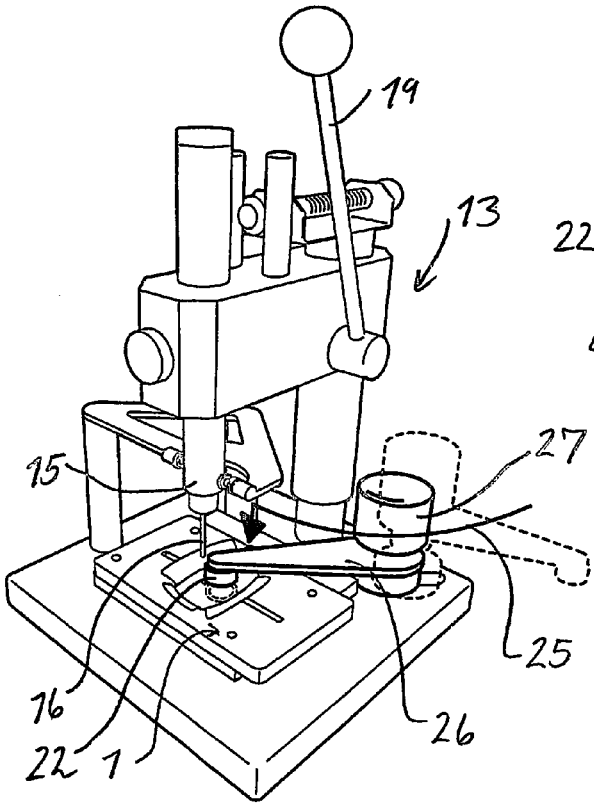
Figure 14:
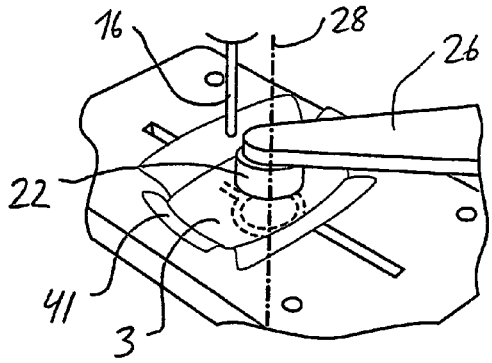
Figure 15:
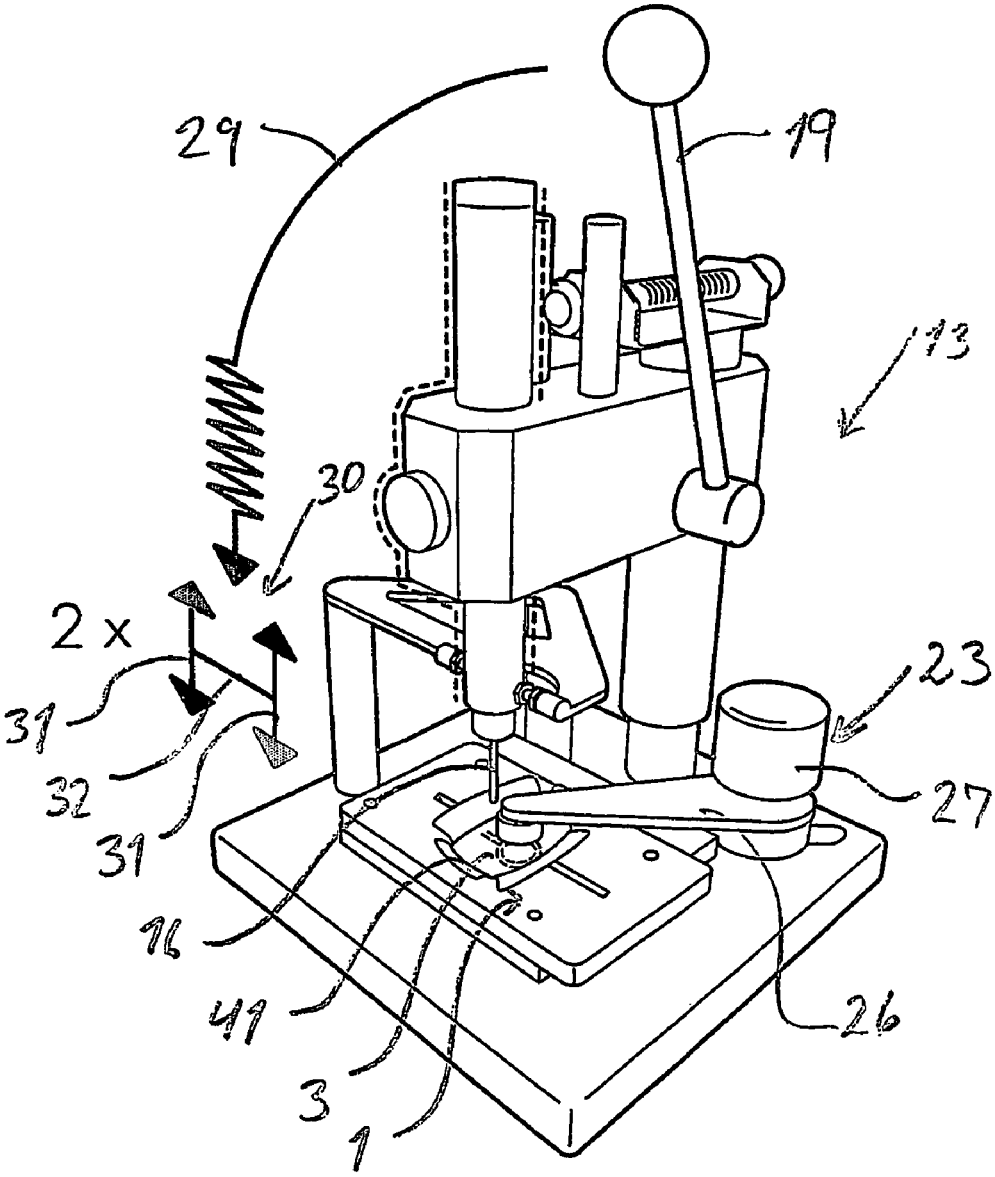
Figure 16:
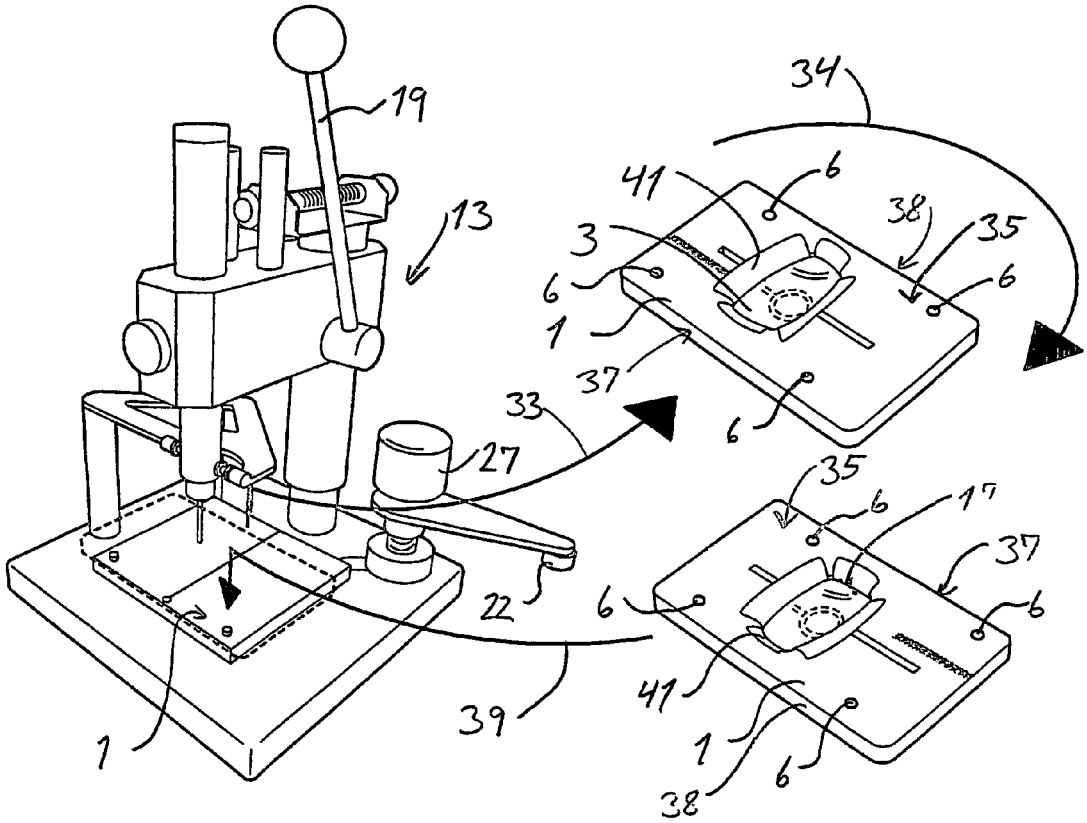

After the lens 3 has been placed in the fixture 1, as illustrated in FIG. 11, the fixture 1 is placed in the apparatus 13 as illustrated in FIG. 12. Subsequently, the pressure pad 22 is swung in and fixes the lens, as illustrated in FIGS. 13 and 14. After that, the assembling holes 17 are formed as illustrated in FIGS. 15 and 16 by turning the fixture as described above.

By using the packing 41 as illustrated in FIGS. 10-16, it is possible to secure the lens 3 in the fixation opening 2 in a fixture in a resilient way, where the fixation opening 2 is oversized and where there will be reduced requirements to tolerances for the fixation opening 2 and the lens 3.

The invention claimed is:

1. Apparatus for use in determining the position of and forming of assembling holes in spectacle lens for rimless spectacles, the assembling holes intended for mounting a bridge and a side bar hinge, including a holder for the lens and machining means that are movable, in two dimensions, relative to the holder, wherein the holder includes a fixture having an opening for fixing the lens at its circumferential rim and at least two first guide means that interact with two corresponding second guide means on an apparatus frame, wherein the first guide means are disposed unambiguously, symmetrically, in relation to a hole centre line for the lens when the latter is placed in the fixation opening that it further includes an elastic ring for placing in a fixation opening at a position between the lens and the apparatus frame for fixing the position of the lens in direction perpendicularly to the plane of the fixation opening, as the lens is pressed down against the ring which thereby is brought into contact against the frame on which the fixture is placed and it includes a packing to be placed between the circumferential edge of the lens and the fixation opening which is formed oversized in relation to the lens.

2. Apparatus according to claim 1, wherein there is provided arms extending from the ring, and the fixture includes cutouts for accommodating the arms in a fixed engagement.

3. Apparatus according to claim 1, wherein a pressure pad is supported on the frame and arranged displaceable in a plane largely in parallel with the fixture so that it can be disposed opposite to the lens in the fixation opening and displaceable in direction perpendicularly thereto for pressing and fixing the lens in a contact position in the fixation opening.

4. Apparatus according to claim 1, wherein the first and the second guide means are guide pins and guide holes, respectively.

5. Apparatus according to claim 1, wherein the fixture has opposed side faces, and that the fixation opening is a through-going opening between these side faces, and the first guide means are provided on both side faces.

6. Fixture for spectacle lens for rimless spectacles and for use in determining the position of and formation of assembling holes in the lens, the assembling holes intended for mounting a bridge and a side bar hinge, wherein the fixture includes an opening for fixing the lens at its circumferential edge and at least two first guide means that are arranged for interaction with two corresponding second guide means on a frame in an apparatus in which the fixture will be placed, wherein the first guide means is placed unambiguously, symmetrically, in relation to a hole centre line for the lens when the latter is placed in the fixation opening that it further includes an elastic ring for placing in the fixation opening in a position between the lens and the apparatus frame for fixing the position of the lens in direction perpendicularly to the plane of the fixation opening, as the lens is pressed down against the ring which is thereby brought in contact against the frame on which the fixture is placed and it includes a packing to be placed between the circumferential edge of the lens and the fixation opening which is formed oversized in relation to the lens.

7. Fixture according to claim 6, wherein the fixture has opposing side faces, and that the fixation opening is a through-going opening between these side faces, and the first guide means are provided on both side faces.

8. Fixture according to claim 6, wherein it includes a packing for placing between the lens circumferential edge and the fixation opening which is oversized in relation to the lens.

9. Packing for use in fixture for spectacle lens for rimless spectacles and for use in determining position of and formation of assembling holes in the lens, the assembling holes being intended for mounting a bridge and a side bar hinge, the fixture including an opening for fixing the lens at its circumferential edge with the packing disposed between the lens and the fixation opening, wherein the packing is largely rectangular with cut off corners, for forming a largely cross-shaped packing, and the packing is formed by a resilient material.

10. Method for fixing spectacle lens for rimless spectacles by determining position of and formation of assembling holes in the lens, and including:

fixing the lens in a fixture for correct hole centre line orientation;

forming the assembling holes;

mounting a bridge and a side bar hinge in the assembling holes; and moving machining means, in two dimensions, relative to the holder, wherein the lens is fixed in a fixture having an opening for fixing the lens at its circumferential edge as a packing is placed between the circumferential edge of the lens and the fixation opening which is formed oversized in relation to the lens that the fixture is fixed in an apparatus via at least two first guide means that are brought to interact with two corresponding second guide means on an apparatus frame, the first guide means being disposed unambiguously, symmetrically, in relation to a hole centre line for the lens, when the latter is placed in the fixation opening that an elastic ring is placed in the fixation opening at a position between the lens and the apparatus frame for fixing the position of the lens in direction perpendicularly to the plane of the fixation opening, as the lens is pressed down against the ring which thereby is brought into contact against the frame on which the fixture is placed.

* * * * *